US009021830B2

(12) United States Patent
Etter et al.

(10) Patent No.: US 9,021,830 B2
(45) Date of Patent: May 5, 2015

(54) COMPRESSOR

(75) Inventors: Wolfgang Etter, Nürtingen (DE); Arno Goerlich, Neuffen (DE)

(73) Assignee: Gea Bock GmbH (DE)

( * ) Notice: Subject to any disclaimer, the term of this patent is extended or adjusted under 35 U.S.C. 154(b) by 0 days.

(21) Appl. No.: 13/513,292

(22) PCT Filed: Nov. 23, 2010

(86) PCT No.: PCT/EP2010/007097

§ 371 (c)(1),
(2), (4) Date: Jun. 1, 2012

(87) PCT Pub. No.: WO2011/066914

PCT Pub. Date: Jun. 9, 2012

(65) Prior Publication Data

US 2012/0234038 A1 Sep. 20, 2012

(30) Foreign Application Priority Data

Dec. 2, 2009 (DE) ..... 10 2009 056 518

(51) Int. Cl.

| | |
|---|---|
| ***F25B 43/02*** | (2006.01) |
| ***F25B 31/00*** | (2006.01) |
| ***F04B 27/18*** | (2006.01) |
| ***F04B 53/18*** | (2006.01) |

(52) U.S. Cl.

CPC ..... *F25B 31/002* (2013.01); *F04B 27/1804* (2013.01); *F04B 53/18* (2013.01); *F04B 2027/1827* (2013.01)

(58) Field of Classification Search

CPC ..... F25B 43/02; F25B 1/00; F25B 3/0062

USPC ..... 62/470, 498, 469; 417/222.2, 269; 92/153

See application file for complete search history.

(56) References Cited

U.S. PATENT DOCUMENTS 4,122,611 A * 10/1978 Marchal et al. ..... 34/73
4,127,363 A 11/1978 Kato et al. ..... 417/269

(Continued)

FOREIGN PATENT DOCUMENTS

DE 273 476 A1 11/1989
EP 0 926 346 A2 6/1999

(Continued)

OTHER PUBLICATIONS

International Search Report dated Jan. 23, 2012 issued in corresponding international patent application No. PCT/EP2010/007097.

(Continued)

*Primary Examiner* — Mohammad M Ali
(74) *Attorney, Agent, or Firm* — Ostrolenk Faber LLP

(57) ABSTRACT

A compressor (10, 200) for compressing refrigerant, having a power unit arranged in a power unit space (14) which is delimited at least partially by a power unit housing (12), having a suction gas volume (46) and having a high-pressure volume (48) is in fluid communication with the power unit space (14) via a second fluid connection (74), wherein the compressor furthermore has a first fluid connection (54, 254) which can be placed in or is in fluid communication with an oil-conducting volume (205) of a refrigeration plant or of the compressor (10, 200), wherein an oil separator (56) is arranged in the first fluid connection (54, 254).

12 Claims, 2 Drawing Sheets

(56) References Cited

U.S. PATENT DOCUMENTS

| | | | | | |
|---|---|---|---|---|---|
| RE31,633 | E | * | 7/1984 | Lewis | 34/381 |
| 4,621,983 | A | | 11/1986 | Thomas et al. | 417/222 |
| 5,088,897 | A | | 2/1992 | Kawai et al. | 417/269 |
| 5,119,571 | A | * | 6/1992 | Beasley | 34/446 |
| 5,741,122 | A | * | 4/1998 | Yokono et al. | 417/222.2 |
| 5,868,556 | A | * | 2/1999 | Umemura | 417/269 |
| 5,983,651 | A | * | 11/1999 | Huang | 62/152 |
| 6,015,269 | A | | 1/2000 | Ota et al. | |
| 6,203,859 | B1 | * | 3/2001 | Scheufler et al. | 427/475 |
| 6,206,648 | B1 | * | 3/2001 | Kimura et al. | 417/222.2 |
| 6,481,240 | B2 | * | 11/2002 | Strikis et al. | 62/470 |
| 6,551,072 | B2 | * | 4/2003 | Ota et al. | 417/222.2 |
| 6,558,133 | B2 | * | 5/2003 | Fukanuma et al. | 417/222.2 |
| 7,014,428 | B2 | * | 3/2006 | Pitla et al. | 417/222.2 |
| 2002/0172602 | A1 | * | 11/2002 | Fukanuma et al. | 417/222.2 |

FOREIGN PATENT DOCUMENTS

| | | | |
|---|---|---|---|
| EP | 1 431 087 | A2 | 6/2004 |
| EP | 2 055 952 | A2 | 5/2009 |
| JP | 2009-63234 | | 3/2009 |
| JP | 2009 063234 | | 3/2009 |
| JP | 2009-109157 | | 5/2009 |
| NL | 125 513 | | 12/1968 |

OTHER PUBLICATIONS

German Search Report issued in corresponding German patent application No. DE 10 2009 056 518.3.

Office Action dated Mar. 26, 2014 issued in corresponding Chinese Patent Application No. 201080054863.7 with English translation.

Office Action dated Aug. 5, 2014 issued in corresponding Australian Patent Application No. 2010327140.

Office Action dated Jul. 31, 2013 issued in corresponding Japanese Patent Application No. 2012-540308 with English translation.

Office Action dated Jul. 11, 2013 issued in corresponding Australian Patent Application No. 2010327140.

Chinese Office Action dated Nov. 17, 2014 issued in Chinese Application No. 201080054863 with English translation.

Summary of Second Office Action dated Nov. 17, 2014 issued in corresponding Chinese Patent Application No. 201080054863.7 with English translation.

* cited by examiner

COMPRESSOR

CROSS-REFERENCE TO RELATED APPLICATIONS

The present application is a 35 U.S.C. §371 national phase conversion of PCT/EP2010/007097, filed Nov. 23, 2010, which claims priority of German Application No. 10 2009 056 518.3, filed Dec. 2, 2009, the contents of which are incorporated by reference herein. The PCT International Application was published in the German language.

BACKGROUND OF THE INVENTION

The invention relates to a compressor as per the preamble of patent claim 1.

Compressors for compressing refrigerant are used in a wide variety of applications nowadays. This is the case for example in the field of (room) air conditioning and also in the field of cooling an extremely wide variety of goods. The field of (room) air conditioning includes inter alia the air-conditioning of residential and office buildings and the air-conditioning of motor vehicles (for example the air-conditioning of passenger compartments of passenger motor vehicles and the air-conditioning of driver's cabs in trucks) and air-conditioning in the rail field (air-conditioning of trains, trams and the like). In the field of cooling, refrigerant compressors are used inter alia in the field of refrigerated transport (for example cooling of semitrailers of trucks, cooling of rail wagons and the like) and in the static field, for example in the field of supermarket refrigeration (cold counters, cooling of storage halls in supermarkets, and other storage halls).

An example of a refrigerant compressor having a power unit which is arranged in a power unit space which is (partially or else entirely) delimited by a power unit housing can be found in the field of air-conditioning of passenger motor vehicles. The compressors for passenger motor vehicles are usually swashplate-type compressors. In said type, the power unit has a swashplate or pivot ring which is pivotably arranged on a drive shaft which is in operative engagement with an engine.

Due to the fact that the swashplate or the pivot ring which is arranged with pistons arranged in cylinder bores, so as to be pivotable with respect to the drive shaft, the swept volume of the piston and therefore the delivery volume of the compressor can be influenced. The delivery volume or the piston stroke of the compressor can be adjusted by means of the pressure prevailing in the power unit space. To regulate or control the piston stroke, said compressors have a low-pressure fluid connection which places the power unit space in fluid communication with a suction gas volume in the form of a suction chamber, and a high-pressure fluid connection which places the power unit space in fluid communication with a high-pressure volume (pressure chamber). In this way, refrigerant can be supplied at high pressure to the power unit space via the high-pressure fluid connection, as a result of which the power unit space pressure is increased. The pressure in the power unit space can be reduced via the low-pressure fluid connection.

The known swashplate-type compressors are oil-lubricated compressors. The rotational movement of the swashplate, the movement of other moving components and the pressure changes cause oil situated in the power unit space to be stirred up and form an oil mist (oil mist lubrication). The oil mist formed in the power unit space is transferred via the low-pressure fluid connection (between power unit space and suction chamber) into the suction chamber and from there, together with the refrigerant, into the cylinders. After compression, the oil mist is delivered partially via the high-pressure fluid connection back into the power unit space, while further parts of the oil pass back into the suction gas volume or the suction chamber via a refrigerant circuit of a refrigerant plant in which the compressor is arranged (in particular via cold or heat exchangers which are arranged in the refrigerant circuit and which take the form of a condenser and an evaporator, and via an expansion member arranged in the circuit). Here, to ensure reliable lubrication, the oil is pumped in the circuit. Refrigerant compressors of this type have an oil filling of approximately 100 g of oil per 1 liter of refrigerant.

It is also the case in compressors which are not of swashplate type (for example compressors with constant piston stroke) that oil passes into the refrigerant circuit and from there back into the suction chamber of the compressor, although in said compressors there is generally no fluid connection between the suction chamber and power unit space.

Compressors for the air-conditioning of passenger compartments of passenger motor vehicles are a mass product which is exchanged in the event of a defect. Repairs are not carried out. Likewise, no maintenance is carried out over the service life of a compressor of said type. This is however not the case in the field of compressors of relatively high refrigeration power. While compressors in passenger motor vehicles have relatively low operating durations, larger compressors for example in buses or for cooling goods in trucks and storage halls are in virtually uninterrupted operation. Owing to the high operating durations, regular maintenance of the compressor is essential. An oil change is also carried out during the regular maintenance work. If oil is present throughout the refrigerant circuit, a part of the old oil remains in the compressor or in the refrigeration plant during the oil change. This would shorten the maintenance intervals. Furthermore, the oil present throughout the refrigerant circuit has disadvantages from an energy aspect; such disadvantages are not of significance in the field of passenger motor vehicle air conditioning, but cause energy losses in the case of larger compressors.

SUMMARY OF THE INVENTION

Accordingly, it is an object of the present invention to specify a compressor which operates cost-effectively and which offers advantages from an energy aspect over the prior art.

Said object is achieved according to the invention by a compressor for compressing refrigerant, as per patent claim 1. It is pointed out at this juncture that the invention is not restricted to swashplate-type compressors. The invention may be realized in all conceivable reciprocating-piston compressors such as for example in-line, V-configuration or W-configuration reciprocating-piston compressors, axial piston compressors and radial piston compressors of constant piston stroke, and also in all conceivable rotary piston compressors, such as for example screw-type, rolling-piston-type, spiral-type and scroll-type compressors.

Further features of the invention are specified in the subclaims.

BRIEF DESCRIPTION OF THE DRAWINGS

The invention will be described by way of example below with reference to the appended drawings on the basis of preferred embodiments. In the drawings.

DESCRIPTION OF PREFERRED EMBODIMENTS

Figure 1:
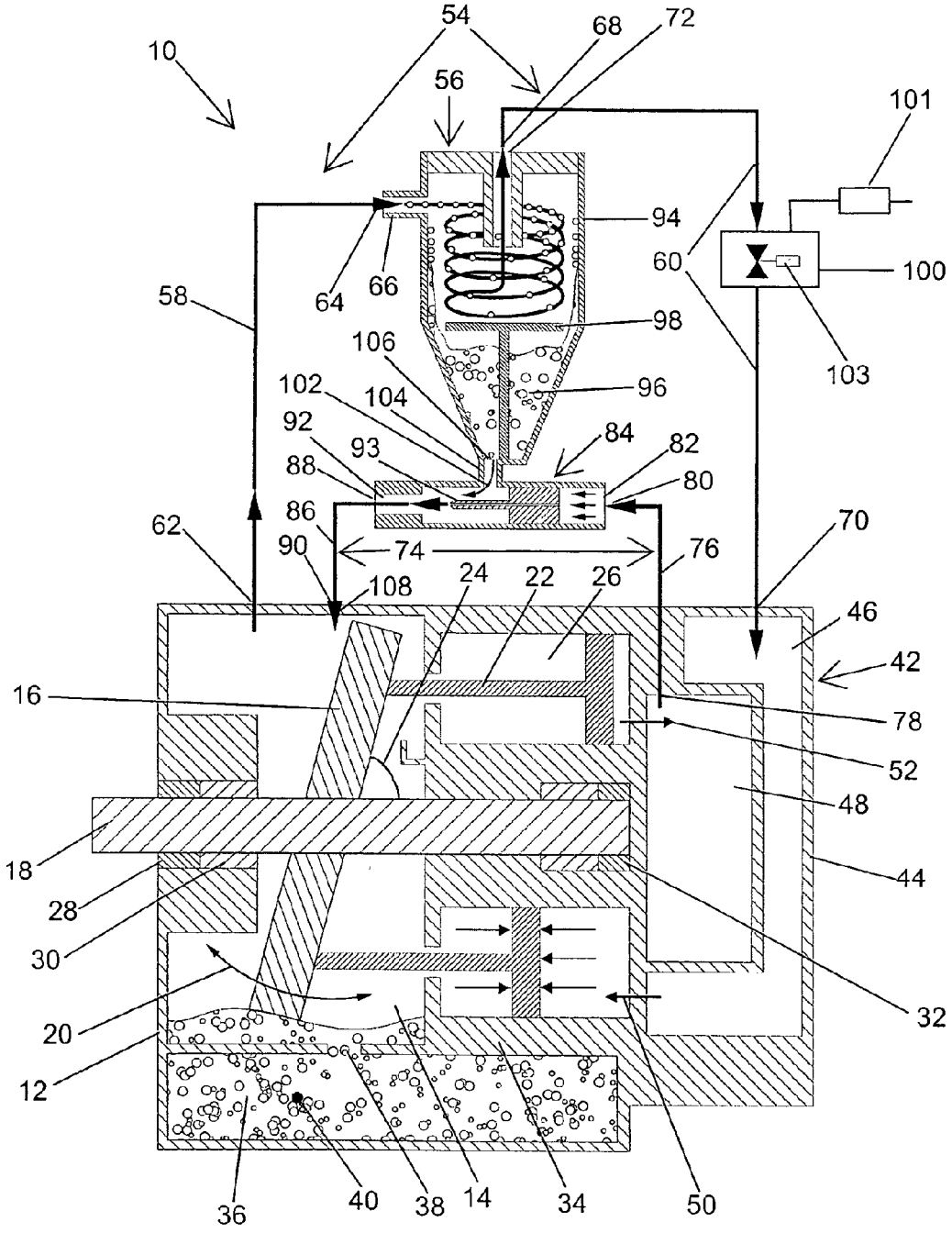
FIG. 1 shows, in a schematic illustration, a first embodiment of a compressor according to the invention.

The first embodiment illustrated in FIG. 1 is a swashplate-type compressor 10. Said compressor has a power unit housing 12 which delimits a power unit space (crank chamber). In the power unit space 14 there is arranged a swashplate 16. In alternative embodiments, the swashplate 16 may also take the form of a pivot ring. The swashplate 16 is driven in rotation by a drive shaft 18 and is in operative connection via sliding blocks (not illustrated in FIG. 1) with pistons 22. In the first embodiment illustrated here, the compressor 10 has five pistons 22. Alternatively to this, however, any other number of pistons is also conceivable.

The swashplate 16, which is connected in a rotationally conjoint manner to the drive shaft 18, is articulatedly connected to the drive shaft 18 by means of a tilting or pivoting mechanism (not illustrated in any more detail and indicated by a double arrow 20) such that it can be adjusted in terms of its inclination (angle of inclination 24) with respect to the drive shaft. The delivery volume of the compressor can be regulated or controlled through the change in the angle of inclination 24 between the drive shaft 18 and the swashplate 16. The greater the extent to which the angle of inclination 24 differs from 90°, that is to say the smaller the angle of inclination becomes, the greater the delivery volume, because the stroke of the pistons 22, which are arranged in cylinder bores 26 assigned to in each case one piston, becomes greater the smaller the angle of inclination 24 is.

The drive shaft 18 is introduced into the power unit space 14 via a sealing element 28 which is arranged in the power unit housing 12 and which is designed as a ring seal and which seals off the power unit space 14 with respect to the environment in a fluid-tight manner. The drive shaft 18 is mounted in the compressor at two points, specifically by means of a first bearing 30, which is arranged in the power unit housing 12, and by means of a second bearing 32, which is arranged in a cylinder block 34 in which the cylinder bores 26 are also arranged. Likewise delimited by the power unit housing 12, the compressor 10 has an oil reservoir 36 which is in fluid connection with the power unit space 14 via an orifice 38. Both in the oil reservoir 36 and also in parts of the power unit space there is situated an oil sump 40 which serves for the lubrication of the compressor 10.

The described first embodiment of a compressor 10 according to the invention furthermore has a cylinder head 42 which is delimited by a cylinder head housing 44. A suction gas volume 46 in the form of a suction chamber or a suction space is arranged in the cylinder head 42. Furthermore, a high-pressure volume 48 in the form of a chamber-like pressure space is arranged in the cylinder head 42. As indicated by a first arrow 50, refrigerant to be compressed flows out of the suction gas volume 46 via an orifice (suction valve, suction aperture) (not illustrated) into the cylinder bores 26, which refrigerant, after the compression process, is discharged out of the high-pressure volume 48 as indicated by a second arrow 52.

Between the power unit space 14 (as an oil-conducting volume of the compressor 10) and the suction gas volume there is arranged a first fluid connection 54 (which, in the embodiment described here, coincides with the low-pressure fluid connection of the swashplate compressor 10). In the first fluid connection 54 there is arranged an oil separator 56 which, in the described first embodiment, is designed as a centrifugal oil separator and has an oil separator inlet 66 and an oil separator outlet 72. The first fluid connection 54 has an oil separator inflow portion 58 and an oil separator outflow portion 60. Here, a first end 62 of the oil separator inflow portion 58 of the first fluid connection 54 is in fluid communication with the power unit space 14, whereas a second end 64 of the oil separator inflow portion 58 of the first fluid connection 54 is in fluid communication with the oil separator inlet 66. The oil separator outflow portion 60 of the first fluid connection 54 in turn has a first end 68 and a second end 70, wherein the first end 68 of the oil separator outflow portion 60 is in fluid communication with the oil separator outlet 72. The second end 70 of the oil separator outflow portion of the first fluid connection 54 is in fluid communication with the suction gas volume 46.

It is pointed out at this juncture that the oil separator inflow portion 58 of the first fluid connection 54 need not necessarily be in fluid communication with the power unit space 14 as an oil-conducting volume. In alternative embodiments, it is also conceivable for the first end 62 of the oil separator inflow portion 58 to be in fluid communication with a low-pressure volume or a low-pressure side of a refrigeration plant (with the principle of which a person skilled in the art is familiar and which will be described in more detail below within the description of the second embodiment), in which the compressor 10 is arranged, as an oil-conducting volume. That is to say, in alternative embodiments, it is conceivable for the first fluid connection not to coincide with the low-pressure fluid connection of the compressor 10 but rather to form a dedicated fluid connection which is separate therefrom and which places the low-pressure side of the refrigeration plant in fluid communication (via the oil filter 56) with the suction gas volume 46.

Furthermore, the compressor according to the invention has a second fluid connection 74 via which the power unit space 14 is in fluid communication (which, in the first embodiment, coincides with the high-pressure fluid connection of the swashplate compressor 10) with the high-pressure volume 48. The second fluid connection 74 has a driving medium portion 76 which is in fluid communication at its first end 78 with the high-pressure volume 48. At its second end 80, the driving medium portion 76 is in fluid communication with a driving medium inlet 82 of an injector 84 which is arranged in the second fluid connection 74 or of a jet pump 84 which is arranged in the second fluid connection 74. The second fluid connection 74 furthermore has an outlet portion 86 which in turn has a first end 88 and a second end 90. Here, the first end 88 of the outlet portion 86 is in fluid communication with an injector outlet 92 arranged on the injector 84, while the second end 90 of the outlet portion 86 is in fluid communication with the power unit space 14.

Since the power unit space 14 is in (uninterrupted) fluid communication with the high-pressure volume 48 of the compressor 10 via the second fluid connection 74 and via the injector 84 arranged therein, the power unit space 14 is acted on continuously with pressurized refrigerant. The refrigerant quantity which flows from the high-pressure volume 48 into the power unit space is determined or limited by an injector nozzle 93 arranged in the injector 84. This is necessary because, to regulate the power of the compressor 10, it is necessary for the pressure in the power unit space 14 to be kept at a higher level than the suction pressure prevailing in the suction volume 46 (depending on the load situation).

The pressure to be set in the power unit space 14 is regulated by means of a point of reducible cross section in the form of a pulse valve 100 which is arranged in the oil separator outflow portion 60 of the first fluid connection 54 and which is connected to an electronic regulating device 101. The pulse valve 100 is opened if the pressure prevailing in the power unit space 14 exceeds the desired pressure, whereas the pulse valve is closed if the desired pressure is undershot. The pulse valve 100 which is used in the first embodiment is an electromagnetically operated solenoid valve, which solenoid valve can be closed by the flow of a current in the associated electromagnet 103. In the described first embodiment, not the power unit space pressure but rather the pressure prevailing in the suction gas volume 46 serves as an actuating or regulating variable. It is pointed out at this juncture that, instead of a pulse valve 100, an (adjustable) aperture, an adjustable slide or some other type of valve would also be conceivable in the oil separator outflow portion 60 of the first fluid connection 54.

As a result of the pressure difference between the pressure prevailing in the power unit space 14 and the pressure prevailing in the suction gas volume 46, refrigerant flows (when the pulse valve 100 is open) into the centrifugal oil separator 56 via the oil separator inflow portion 58 of the first fluid connection 54 and the oil separator inlet 66, which refrigerant entrains an oil mist stirred up owing to the flow conditions and owing to the rotational movement of the swashplate 16. As it flows into the centrifugal oil separator 56, the gas is set in rotation, as a result of which, owing to the centrifugal forces, the oil droplets in the oil mist are thrown against an oil separator housing 94, which oil droplets collect in a lower region of the centrifugal oil separator in an oil separator reservoir 96. In order to prevent the oil which is situated in the oil separator reservoir 96 and which runs down the wall of the oil separator housing 94 in the form of an oil film from being stirred up again, the centrifugal oil separator 56 has a T-shaped or mushroom-shaped impact sheet or a T-shaped or mushroom-shaped impact plate 98, and the refrigerant which has been set in rotation and which has now been freed of oil mist is deflected by said impact plate in the direction of the oil separator outlet 72 and exits said centrifugal oil separator again through said oil separator outlet.

In the injector 84 or the jet pump, a pumping action is generated by a fluid jet (driving medium) which enters the injector 84 through the driving medium inlet 82, which pumping action causes a medium to be suctioned, which in this case is the oil from the centrifugal oil separator 56 (which is mixed with refrigerant), to be sucked in via a suction medium inlet 102 of the injector 84, accelerated and discharged again through the injector outlet 92. For the supply of oil at the suction medium inlet 102, the latter is in fluid communication with an oil outlet 106 of the centrifugal oil separator 56 via a third fluid connection 104.

Here, the entrained oil is introduced into the power unit space 14 at the second end 90 of the outlet portion 78 of the second fluid connection 74 via a power unit space inlet 108 arranged there, wherein the power unit space inlet 108 is arranged in the region of points of the compressor 10 which are to be lubricated, in the first embodiment described here above the swashplate 16, such that the latter is supplied continuously with oil or lubricant. In addition or alternatively to this, it would also be conceivable for further power unit space inlets 108 to be arranged in the compressor, which further power unit space inlets supply oil to further points to be lubricated (for example bearings) (in this regard, see also the second embodiment of a compressor according to the invention described below).

Since the oil which passes through the injector 84 has refrigerant components or is mixed with or contains refrigerant, the entrained refrigerant, after passing through an injector nozzle (expansion member) arranged in the injector, is cooled (owing to the expansion), which leads to cooling of the oil. As a result, heating of the power unit space 14 and of the power unit housing 12 is prevented or reduced. The concept of the invention accordingly also encompasses the arrangement of a device for oil cooling in a compressor. Said concept is not limited to compressors which have an oil separator. In fact, compressors are also conceivable which do not have an oil separator and which nevertheless have a device for oil cooling. For example, it is conceivable for the injector 84 to be supplied with an oil-refrigerant mixture not by means of an oil separator (centrifugal oil separator 56) but rather by means of an oil pump, wherein the entrained oil which serves for lubrication is cooled as it flows through the expansion member in the form of the injector nozzle (primarily as a result of the expansion of the entrained refrigerant). The basic idea of implementing an oil cooling device in a compressor is not limited to the use of an injector or of some other arbitrary expansion member. Oil cooling by means of an air-cooled, water-cooled or refrigerant-cooled oil cooler or an oil cooler cooled in some other way, which oil cooler may be arranged at any desired location in a compressor oil circuit, is also conceivable.

Figure 2:
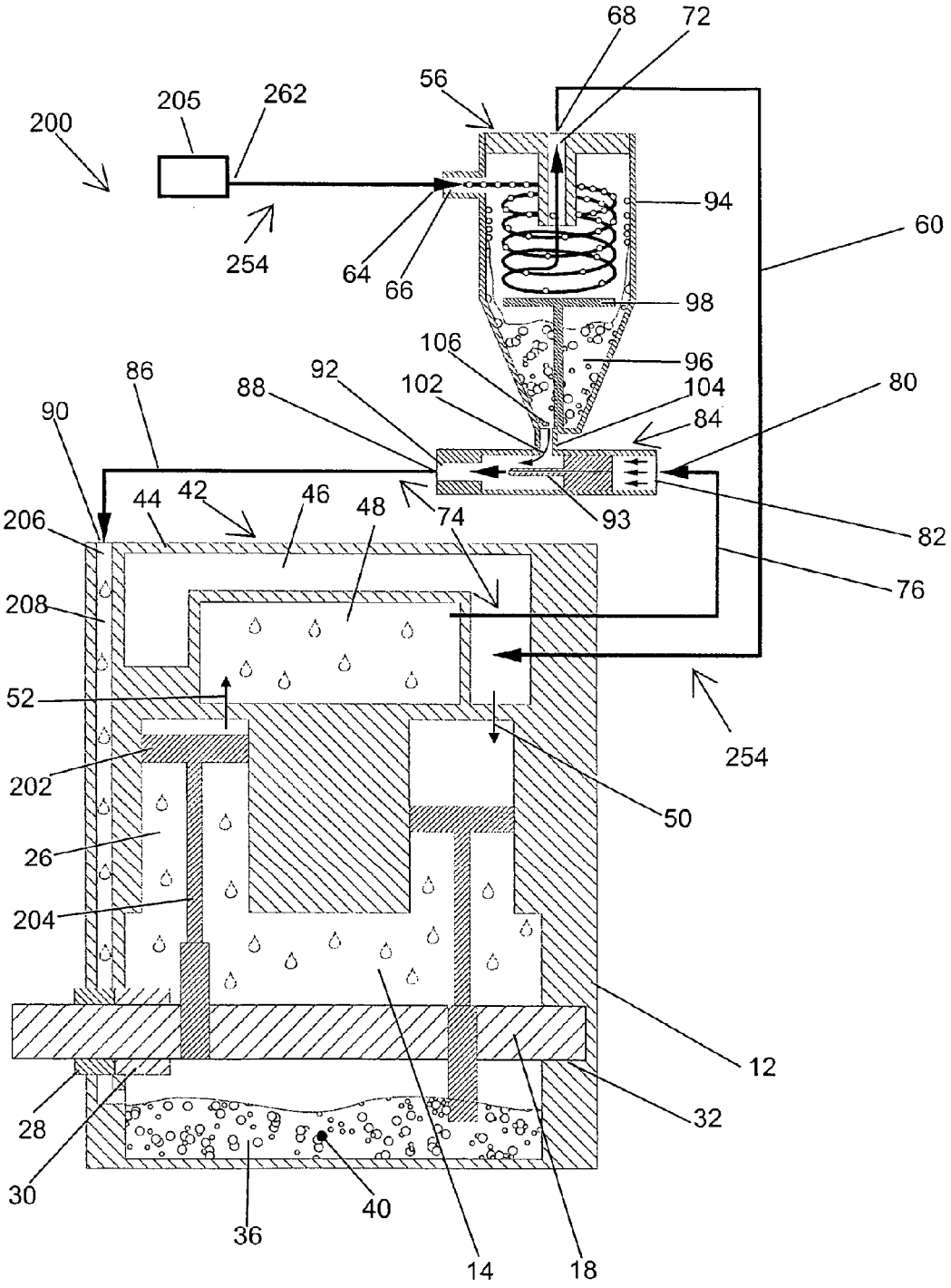
FIG. 2 shows, again in a schematic illustration, a second embodiment of a compressor according to the invention.

As already mentioned above and as can also be seen from FIG. 2, the compressor need not be a swashplate-type compressor. The compressor 200 illustrated in FIG. 2 is an in-line reciprocating-piston compressor which operates on the oscillating delivery principle and which has a constant piston stroke. In the embodiment illustrated in FIG. 2, the compressor 200 has two pistons 202. The pistons 202 are in operative engagement with the drive shaft 18 via connecting rods 204 mounted on the pistons 202 themselves and on said drive shaft. The number of pistons 202 is self-evidently not restricted to two. Any conceivable number of pistons 202 is conceivable.

The compressor 200 according to the second embodiment also has a suction gas volume 46, a high-pressure volume 48 and a power unit space 14. A second and third fluid connection 74, 104 and an injector 84 are arranged analogously to the first embodiment. That is to say the second fluid connection 74 is again arranged between the high-pressure volume 48 and the power unit space 14 and permits fluid communication between the high-pressure volume 48 and the power unit chamber 14 or the points to be lubricated (bearings, seals etc.) arranged in said power unit chamber. Analogously to the first embodiment, an injector 84 or a jet pump is arranged in the second fluid connection 74. The third fluid connection 104 places the oil separator 56 in fluid communication with the injector 84.

All the components denoted by reference numerals already known from the first embodiment correspond in terms of design and functionality to those of the first embodiment, such that said components will not be mentioned or described again during the description of the present second embodiment. The differences between the first and second embodiments will be explained below.

In contrast to the swashplate-type compressor 10 (first described embodiment), the compressor 200 of the second embodiment has a first fluid connection 254 which is modified in comparison with the first embodiment. Said first fluid connection duly also has an oil separator inflow portion 258 and an oil separator outflow portion 60, wherein the oil separator outflow portion 60 corresponds in terms of its arrangement and functionality to the oil separator outflow portion 60 of the first described embodiment; the oil separator inflow portion 258 of the second possible embodiment however differs in terms of its arrangement and functionality from the oil separator inflow portion 58 of the first embodiment. The oil separator inflow portion 258 can be placed in fluid communication at a first end 262 to a low-pressure side 205 of a refrigeration plant (the refrigeration plant is not illustrated in the drawings; the basic design of a refrigeration plant and the refrigerant circuit thereof is known to a person skilled in the art) via a suitable connection (for example connector device). In this way, it is provided that oil which is situated in the refrigerant circuit of the refrigeration plant (oil which, after the compression process, passes via the high-pressure volume 48 into the refrigerant circuit of the refrigeration plant in which the compressor 200 is arranged) passes out of the low-pressure side of the refrigeration plant, which likewise (like the power unit space 14) constitutes an oil-conducting volume of the refrigeration plant, via the oil filter 56 and back into the power unit space 14 of the compressor 200. For this purpose, a second end 64 of the oil separator inflow portion 258 of the first fluid connection 254 is in fluid communication, analogously to the first embodiment, with the oil separator inlet 66. The low-pressure side 205 of the refrigeration plant is that portion of the refrigerant circuit which is at low pressure, that is to say the portion between an expansion member of the refrigeration plant and the suction gas volume 46 of the compressor 200. In the described embodiment, it is provided that the first end 262 of the first fluid connection 254 is placed in fluid communication with a portion of the refrigerant circuit which is arranged between the expansion member and an evaporator of the refrigerant plant. With such a design, it is possible to ensure lubrication of the compressor 200 by means of the oil which has passed into the refrigerant circuit.

The delivery volume of the second embodiment of a compressor according to the invention is regulated by activating and deactivating the compressor 200. In this way, it is possible to dispense with the pulse valve 100 because ideal (preferably approximately constant) conditions, in particular an ideal oil supply to the points to be lubricated, can be ensured through suitable selection of the throughflow rates of the first, second and third fluid connections 54, 74, 104.

The throughflow rates, which are defined as the quantity of refrigerant/refrigerant-oil mixture/oil which flows through the respective fluid connection 54, 74, 104 per unit of time, may be ensured for example by means of a suitable geometry of the cross section of the fluid connections 54, 74, 104 and/or a suitable selection of the injector 84. As an alternative to this, it is self-evidently also conceivable for points of reduced or reducible cross section (such as for example apertures, valves) to be provided in this embodiment.

In the second embodiment, the second fluid connection is in fluid communication with a power unit space inlet 206 which opens into a tubular lubricant supply duct 208. The lubricant supply duct 208 is in turn in fluid connection with the first bearing 30 and with the first sealing element 28 in order thereby to ensure lubrication of the first bearing 30 and optimum functioning of the sealing element 28. It is self-evidently conceivable for a compressor according to the invention to have multiple power unit space inlets 208 which are in fluid communication with the second fluid connection, whereby multiple points to be lubricated are supplied with lubricant. This consideration also applies to the first embodiment. Alternatively or in addition, it is also conceivable for the power unit space inlet 208 (in the first embodiment 108) to be in fluid communication, for example via the (then correspondingly formed or branched) lubricant supply duct 208, with multiple points to be lubricated. The supply to the points of the compressor 200 to be lubricated takes place analogously to the first embodiment.

In both of the described embodiments, and also in alternative embodiments, it is conceivable for at least parts of the oil filter 56 (for example the oil separator housing 94 and/or the impact plate 98 and/or further constituent parts of the oil filter 56) or the oil filter 56 as a whole to be formed integrally with the compressor housing, and therefore produced, for example cast, in one working step with the production of the housing. The same applies to the first, second and third fluid connections 54, 74, 104, 254 which may likewise be formed partially or entirely integrally with the compressor housing or arranged or formed therein.

The concept of the invention encompasses not only the specification of a compressor 10, 200 designed according to the invention but rather also the specification of a corresponding refrigeration plant having a refrigerant circuit, which refrigeration plant has a high-pressure side (high-pressure volume) and a low-pressure side (low-pressure volume 205) and also a compressor 10, 200 according to the invention, as defined above by the description of the figures and by the appended patent claims. Further constituent parts of the refrigeration machine (condenser, expansion member and evaporator) are familiar to a person skilled in the art and are likewise described in more detail above.

It is also pointed out at this juncture that the oil separator 56 self-evidently need not be a centrifugal oil separator, but rather any other oil separator, for example an oil separator with sieve bodies or filter elements, is conceivable.

In summary, the following points in particular are mentioned once again:

1. The entrained oil is separated from the gas flow by a centrifugal oil separator and is conducted to the base of the separator by the rotation and by gravity.

2. To discharge the accumulating oil (in the case of the first preferred embodiment), the bypass which is provided for capacity regulation and which is formed between the high-pressure volume 40 and the power unit space 14 in the form of the first fluid connection 54 is utilized. The pressure difference between the power unit space 14 and the high-pressure volume 40 makes it possible to operate the injector or the jet pump 84, which sucks the accumulated oil out of the oil separator 56 and transports said oil via corresponding fluid connection (outlet portion 86 of the second fluid connection 74) to the required lubrication points.

3. The fact that the entrained refrigerant causes cooling of the refrigerant and of the oil after passing through an injector nozzle (an expansion member which is arranged in the injector), undesired heating of the power unit space 14 and of the power unit housing 12 is prevented or at least reduced.

By means of such a design, it is ensured that the highly loaded components of the compressor are supplied continuously with lubricant.

Even though the invention is described on the basis of embodiments with fixed combinations of features, the invention however also encompasses the further conceivable advantageous combinations as specified in particular, but not exhaustively, by the subclaims. All of the features disclosed in the application documents are claimed as being essential to the invention where they are novel, individually or in combination, over the prior art.

LIST OF REFERENCE NUMERALS

10 Compressor
12 Power unit housing
14 Power unit space
16 Swashplate
18 Drive shaft

20 Double arrow
22 Piston
24 Angle of inclination
26 Cylinder bore
28 Sealing elements
30 First bearing
32 Second bearing
34 Cylinder block
36 Oil reservoir
38 Orifice
40 Oil sump
42 Cylinder head
44 Cylinder head housing
46 Suction gas volume
48 High-pressure volume
50 First arrow
52 Second arrow
54, 254 First fluid connection
56 Centrifugal oil separator/oil separator
58, 258 Oil separator inflow portion of the first fluid connection 54
60 Oil separator outflow portion of the first fluid connection 54
62, 262 First end of 58 or 258
64 Second end of 58 or 258
66 Oil separator inlet
68 First end of 60
70 Second end of 60
72 Oil separator outlet
74 Second fluid connection
76 Driving medium portion of the second fluid connection 74
78 First end of 76
80 Second end of 76
82 Driving medium inlet
84 Injector/jet pump
86 Outlet portion
88 First end of 86
90 Second end of 86
92 Injector outlet
93 Injector nozzle
94 Oil separator housing
96 Oil separator reservoir
98 Impact plate
100 Pulse valve
102 Suction medium inlet
104 Third fluid connection
106 Oil outlet
108 Power unit space inlet
200 Compressor
202 Piston
204 Connecting rod
205 Low-pressure side of a refrigeration plant
206 Power unit space inlet
208 Lubricant supply duct

What is claimed is:

1. A compressor for compressing refrigerant, comprising a power unit arranged in a power unit space which is delimited at least partially by a power unit housing, having a suction gas volume and having a high-pressure volume, wherein the high-pressure volume is in fluid communication with the power unit space via a second fluid connection, wherein the compressor furthermore has a first fluid connection which can be placed in or is in fluid communication with an oil-conducting volume of a refrigeration plant or of the compressor, wherein an oil separator is arranged in the first fluid connection, wherein the oil separator has a centrifugal oil separator, wherein the oil separator has a refrigerant outflow portion, and an oil outlet, which is in fluid communication, via a third fluid connection, with the second fluid connection between the high-pressure volume and the power unit space, and wherein the oil outlet is in fluid communication with an injector, which is arranged in the second fluid connection between the high-pressure volume and power unit space and which is in fluid communication with the second fluid connection, or with a jet pump which is arranged there and which is in fluid communication with the second fluid connection, wherein the compressor comprises an oil reservoir which is the bottom part of the power unit space, and wherein a valve is provided between the refrigerant outflow portion of the oil separator and a suction gas volume to regulate pressure inside the power unit space.

2. The compressor as claimed in claim 1, wherein the oil-conducting volume is the suction gas volume of the compressor or a low-pressure volume of the refrigeration plant.

3. The compressor as claimed in claim 1, wherein the injector or the jet pump has a driving medium inlet, a suction medium inlet and an injector outlet, wherein the driving medium inlet is in fluid communication with the high-pressure volume via a driving medium portion of the second fluid connection, said driving medium portion being arranged between the high-pressure volume and the driving medium inlet, wherein furthermore the injector outlet is in fluid connection with the power unit space via an outlet portion of the second fluid connection, said outlet portion being arranged between the injector outlet and the power unit space, and wherein the suction medium inlet is in fluid connection with the oil outlet of the oil separator via the third fluid connection which is arranged between the suction medium inlet and the oil outlet of the oil separator.

4. The compressor as claimed in claim 1, wherein the second fluid connection is in fluid communication with at least one power unit space inlet arranged in the power unit housing, wherein said power unit space inlet is arranged in the region of a lubrication point to be lubricated.

5. The compressor as claimed in claim 1, wherein the oil separator has an oil separator inlet and an oil separator outlet, wherein the oil separator inlet is in fluid communication with the power unit space or with a low-pressure volume of the refrigeration plant via an oil separator inflow portion of the first fluid connection, said oil separator inflow portion being arranged between the power unit space of the compressor or a low-pressure volume of the refrigeration plant and the oil separator inlet, and wherein the oil separator outlet is in fluid communication with the suction gas volume via an oil separator outflow portion of the first fluid connection, said oil separator outflow portion being arranged between the oil separator outlet and the suction gas volume.

6. The compressor as claimed in claim 1, wherein a point of reduced or reducible cross section, in particular a valve or an aperture, is arranged in the first fluid connection.

7. The compressor as claimed in claim 6, wherein the point of reduced or reducible cross section is a pulse valve.

8. The compressor as claimed in claim 6, wherein the point of reduced or reducible cross section is arranged in the oil separator outflow portion of the first fluid connection.

9. The compressor as claimed claim 1, wherein the power unit comprises a swashplate or a pivot ring.

10. The compressor, as claimed in claim 1, wherein the compressor comprises an oil cooling device.

11. The compressor as claimed in claim 10, the oil cooling device has an expansion member.

12. The compressor as claimed in claim 10, wherein the oil cooling device is arranged in the injector.

* * * * *